United States Patent [19]

Shine

[11] 4,319,425

[45] Mar. 16, 1982

[54] GRAVITY OPERATED TRACK

[76] Inventor: Thomas M. Shine, 36 E. 28th Ave., Spokane, Wash. 99203

[21] Appl. No.: 145,688

[22] Filed: May 1, 1980

[51] Int. Cl.[3] ..... A63H 33/00; A47G 29/00; A62C 31/22

[52] U.S. Cl. ..... 46/43; 46/1 K; 248/88; 239/276; 238/10 E

[58] Field of Search ..... 46/43, 1 K; 239/276, 239/280.5; 248/82–88, 65, 67, 70, 74 A; 238/10 E, 10 R, 10 A

[56] References Cited

U.S. PATENT DOCUMENTS

| | | | |
|---|---|---|---|
| 1,870,752 | 8/1932 | Keihing | 46/43 |
| 2,000,808 | 5/1935 | Williams | 46/43 |
| 2,451,699 | 10/1948 | Twaroski | 248/74 A |
| 3,083,967 | 4/1963 | Steel | 273/54 |
| 3,132,441 | 5/1964 | Mahovsky | 46/43 |
| 3,394,489 | 7/1968 | Martin | 46/43 |
| 3,516,630 | 6/1970 | Janssens | 248/70 X |
| 3,587,190 | 6/1971 | Ashion | 46/43 |
| 3,588,012 | 6/1971 | Schaefer | 248/87 X |
| 3,683,514 | 8/1972 | Hughes | 35/19 R |
| 3,841,223 | 10/1974 | Bertin | 238/10 R X |
| 3,941,342 | 3/1976 | Bradshaw | 248/88 |
| 4,171,090 | 10/1979 | Eisenburg | 46/43 X |

*Primary Examiner*—Robert Peshock
*Assistant Examiner*—Mickey Yu
*Attorney, Agent, or Firm*—Wells, St. John & Roberts

[57] ABSTRACT

A toy that makes use of conventional garden hose or similar flexible tubing to form a rolling track for marbles. The toy includes a number of supports that function to hold the hoses in longitudinal contact at desired height and angular relationships to the supporting surface, thereby defining the course along which a marble will roll. Height may be adjusted by adding or removing lengths of upright supports. Angular "banking" of the track is accomplished by angular positioning clamp members that mount the track to the supports.

6 Claims, 5 Drawing Figures

GRAVITY OPERATED TRACK

TECHNICAL FIELD

The present invention relates to track type toys, especially those used for guiding a marble or other spheroid object along a formed, elongated track.

BACKGROUND

Track toys are currently gaining popularity as evidence the current demand for toy car tracks. Theoretically, the appeal of such track toys is the thrill of watching moving objects (cars, trains, etc.) move about a path defined by usually fixed track. Though there is a certain element of chance that the moving vehicle will "crash" there is seldom any real challenge in constructing the track for the end purpose of keeping the vehicle in position on the track as it rolls from one end to the other.

Existing track toys make use of especially formed tracks that are constructed specifically for particular toy vehicles. The expense involved in obtaining such toys is often prohibitive. It therefore becomes desirable to produce a toy from relatively commonly found track material so the cost is minimal. Furthermore, it is also desirable to produce such a toy that presents a construction challenge to the player(s) to produce an elongated, inclined track over which a spherical object such as a marble will roll without dropping from the track.

U.S. Pat. Nos. 3,587,190 and 2,000,808 illustrate flexible marble runways that represent a partial response to the needs described above. Both illustrate flexible marble runways. Pat. No. 3,587,190 to Ashton shows a runway made from two plastic guide rails. Pat. No. 2,000,808 to Williams discloses a simple trough that makes use of banked corners.

A number of games include runways or tracks formed from solid or tubular material. The Mahovsky U.S. Pat. No. 3,132,441 shows a ball rolling toy comprised of a pair of "hula hoops" which are held in dual clips. The clips are not adjustable.

The Reihing U.S. Pat. No. 1,870,752 and the Hughes U.S. Pat. No. 3,682,514 illustrate game structures with dual track supports for a ball. The Reihing toy makes use of resilient rods to form the tracks. The tracks can be elevationally deflected to cause movement of a ball or marble positioned between the two rods. Specific elevational adjustment of the tracks cannot be made beyond the range dictated by the resiliency of the rods.

A dual track bowling ball support is shown in the Steel U.S. Pat. No. 3,083,967. The bowling ball support has adjustable support rails by which a user can control the delivery of a bowling ball. The rails appear to be formed of rigid material.

The above patents relate to the basic elements and are illustrative of the desirability to obtain a variable track type toy or support arrangement. None of these patents indicate the general toy combination or the specific support that is disclosed in the present application.

DETAILED DESCRIPTION OF A PREFERRED EMBODIMENT

Figure 1:
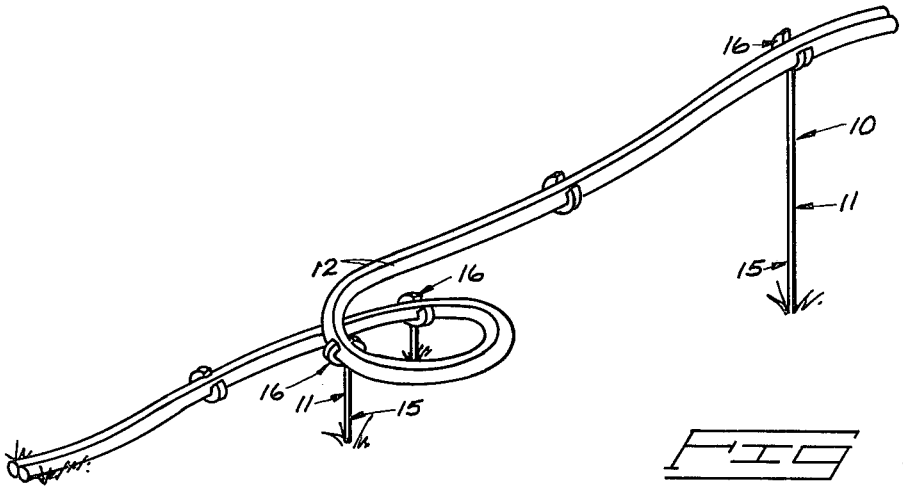
FIG. 1 is a pictorial view of the present toy in use.

The toy embodying a preferred form of the present invention basically includes a number of track supports 11 elevationally holding flexible tubular tracks 12 such as garden hose sections, in longitudinal tangential engagement.

The track supports can be removably attached to standard tubular members 12 such as garden hose sections so the toy can be marketed with or without the tubular tracks 12. The supports 11 can be produced separately and sold in selected numbers for interconnecting two standard size garden hose sections in parallel relation to form the tracks 12. Alternatively, the toy can be marketed with the "tracks" and supports together as a unit.

Each of the track supports 11 includes an upright clamp support means 15, a clamp means 16, and an adjusting means 17. The clamp support means 15 is provided to elevationally position the clamp means and adjusting means relative to the ground or other support surface. The clamp means 16 is utilized to removably receive and hold the tubular tracks 12 together, preferably touching tangentially along their lengths. The adjusting means 17 is situated between the clamp means and support means to enable adjustment of the clamp means and track supported thereby about an axis that is oriented longitudinally with the longitudinal axis of the tubular tracks. This is done to "bank" or "tilt" the tracks around turns so a marble 13 or other spherical ball can roll the full length of the tracks without dropping off.

Figure 2:
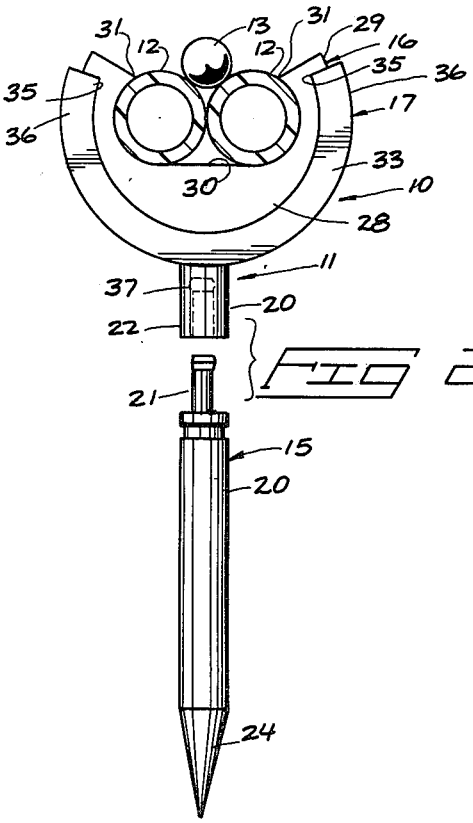
FIG. 2 is an elevational view of the support assembly.
Figure 4:
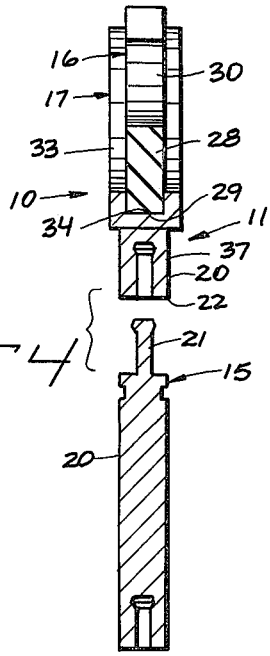
FIG. 4 is an exploded sectional view taken along line 4—4 in FIG. 2.
Figure 3:
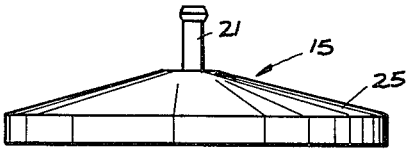
FIG. 3 is an elevation view of an alternate base for the support assembly.

The clamp support means 15, shown in detail by FIGS. 2–4, is preferably extensible by means of several interconnected upright sections 20. The sections 20 will each include a male end 21 and a female end 22. The individual sections can be made in varied lengths so the height from the ground or floor surface to the clamp means 16 can be selectively varied.

The top end of the sections 20 are connected to the clamp means 16 while the bottom ends are provided with one of two forms of bases 24, 25 shown in FIGS. 1 and 3. FIG. 3 is illustrative of a form of base 25 to be used indoors or on a solid support surface. For outdoors along the ground surface, pointed base ends 24 (FIG. 2) can be pushed into the ground surface to secure the track support in place.

Figure 5:
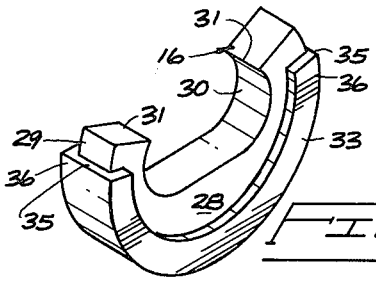
FIG. 5 is a pictorial view of a single clamp member.

The clamp means 16 is shown in detail by FIGS. 2 and 5. Each of the clamp means 16 is basically comprised of a "U" shaped disk 28 that is substantially semicircular around its outer arcuate surface 29. The surface 29 leads to a track receiving recess 30. Transition from the arcuate circular surface 29 to the recess 30 is made at abrupt edges or points 31 of the recess 30. The distance between points 31 is somewhat less than the combined cross-sectional diameters of the tubular tracks 12 (FIG. 2). The recess is complementary to the cross-sectional configurations of the tubular tracks when they are held in longitudinal engagement. The tubular members preferably are flexible garden hoses, and as such, will flex or deform slightly while being "snapped" into recess 30.

The clamp means 16 is mounted to the clamp support means 15 by the adjusting means 17. Adjusting means 17 functions to allow pivotal movement of the clamp means 16 about an axis that is substantially parallel with the longitudinal axes of the tubular tracks. This allows "banking" of the tracks at selected angles relative to the ground or floor support surface. The adjusting means is preferably comprised of an upwardly facing "U" shaped bracket 33. The bracket 33 includes a semicircular surface 34 (FIG. 4) that is complementary to the surface 29 on disk 28.

The surface 34 extends about a longitudinal central axis to end edges 35 that are spaced apart by a distance only slightly less than the diameter of the semicircular surface 29. The disk can therefore be snapped into place within the bracket 33 between end flanges 36 thereon. The disk can as easily be pulled outwardly for removal from the bracket 33. The edges 35 will cam over the circular surface 29 and snap back into place once the disk is removed.

The bracket 33 includes a downwardly projecting mount 37 which receives the upward end of the clamp support means 15. The mount 33 can be used alone to support the bracket and clamp means at a minimum height above a support surface or can be selectively connected to any number of interconnected support sections.

Prior to operating the present invention, the player must first construct the track. This is done by placing two hose sections (or supplied tubular members) adjacent one another. Alternately, two separate hoses can be stretched out one alongside the other. The player can then connect several of the supports to the hoses at spaced intervals along their lengths. The supports are then set up according to desired elevations, in general descending order from a relatively high elevation at one end to a low elevation at the other end.

It may be noted that the disks 28 may be used separately as intermediate support members along the length of the tubular tracks to hold the tracks together at points intermediate the interfitted supports 11. Extra disks 28 can be supplied or individual disks can be removed from the "U" shaped brackets 33. It may be preferred to place a disk 28 after each track support 11 along the full length of the tracks 12. When the selected height adjustment has been made either by adding or removing sections 20 or by sinking the point 24 to a selected depth within the ground, the remaining adjustments for banking can be made. This is done simply by pivoting the disks 28 within the U shaped brackets 33. The disks pivot about their center axis and will stay in the selected angular position due to the frictional engagement between the disks and the surfaces 34. If the elevations have been properly set and the curves properly banked, a marble will roll the full length of the hoses. This is the ultimate goal of the player. If the marble does not remain on the track for its full length, further adjustment needs to be made.

The supports 11 are easily removed from the tubular tracks. Thus, hoses used for tubular tracks 12 will be freed for other more conventional uses and the materials may be easily stored.

The above description and drawings are given as examples to set forth a preferred form of the present invention. The following claims more precisely set out the scope of the invention.

What I claim is:

1. A gravity operated toy track comprising:

a spherical object such as a marble;

a pair of elongated cylindrical tubular sections formed of flexible tubular wall material such as garden hose having prescribed outer diameters;

a clamp means for releasably securing the cylindrical tubular sections together in abutting longitudinal relationship at spaced intervals along their lengths to form flexible tracks for receiving the spherical object thereon;

clamp support means for holding the clamp means at selected elevations along the lengths of the tracks above a support surface to enable the spherical object to move along the tracks by the force of gravity in a vertically curved path; and said clamp means having angular adjusting means for enabling the abutting flexible tracks held thereby to be manually angularly oriented about an adjusting axis that is substantially parallel with respect to the longitudinal dimension of said tracks to bank the tracks and enable the spherical object to move in a desired horizontally curved path without jumping the tracks.

2. The gravity operated toy track as defined by claim 1 wherein the support means includes an extensible upright support section having an upper end, attachable to the adjusting means, and a bottom end;

base means at the bottom end for holding the support section in an upright orientation relative to a support surface.

3. The gravity operated toy track as defined by claim 1 wherein the clamp means is comprised of a semicircular disc having a semicircular arcuate bearing surface leading to a track receiving recess for releasably receiving the flexible tracks; and wherein the adjusting means is comprised of a "U" shaped frame having an arcuate bearing surface corresponding to the arcuate surface of the semicircular disc for slidably engaging the disc to enable the disc to be rotated about the adjusting axis to angularly adjust the position of the tracks.

4. The gravity operated toy track as defined by claim 3 wherein the bearing surface of the "U" shaped frame is complementary to and in engagement with a bearing surface of the semicircular disc.

5. The gravity operated toy track as defined in claim 1 wherein the clamp means includes a track receiving recess has an entrance opening with a width less than the sum of the prescribed outer diameters of the flexible tubular sections requiring the flexible tubular walls to radially compress to be releasably inserted into the track receiving recess.

6. The gravity operated toy track as defined by claim 4 wherein the "U" shaped frame is mounted to the elevational support means.

* * * * *